United States Patent [19]

Couwenbergs

[11] 3,961,453

[45] June 8, 1976

[54] SUPPORTS FOR CONSTRUCTIONAL OR BUILDING ELEMENTS

[76] Inventor: Paul Couwenbergs, Altfeldstr. 5, D-7500 Karlsruhe 21, Germany

[22] Filed: May 17, 1974

[21] Appl. No.: 471,150

[30] Foreign Application Priority Data

May 17, 1973 Germany ..... 7318461

[52] U.S. Cl. ..... 52/509; 52/122; 52/480

[51] Int. Cl.[2] ..... E04C 1/10

[58] Field of Search ..... 404/43; 52/134, 126, 52/122, 480, 509

[56] References Cited

UNITED STATES PATENTS

| | | | |
|---|---|---|---|
| 2,610,856 | 9/1952 | Welty | 46/25 |
| 3,096,695 | 7/1963 | Reinhardt | 404/43 |
| 3,214,874 | 11/1965 | Roberts | 52/590 |
| 3,398,933 | 4/1968 | Haroldson | 52/126 |
| 3,470,663 | 10/1969 | Tate | 52/126 |
| 3,505,764 | 4/1970 | Gutierrez | 52/126 |
| 3,564,786 | 2/1971 | Baker | 52/79 |

FOREIGN PATENTS OR APPLICATIONS

| | | | |
|---|---|---|---|
| 1,359,353 | 3/1964 | France | 52/480 |
| 2,034,331 | 1/1972 | Germany | |
| 1,196,345 | 8/1965 | Germany | 52/126 |
| 1,961,889 | 6/1971 | Germany | 52/126 |
| 269,166 | 9/1961 | Netherlands | 52/480 |

*Primary Examiner*—Ernest R. Purser
*Assistant Examiner*—Henry Raduazo
*Attorney, Agent, or Firm*—Craig & Antonelli

[57] ABSTRACT

A support for flat building elements comprising a plate for engaging the element, having on one side four retaining members at the corners of a square. Each retaining member is divided along part of a diagonal of the square. The plate may be disc-shaped or in the form of portions of uniformly graduated thicknesses and the same cross-sectional shape. The plate may be apertured symmetrically between each pair of adjacent retaining members, the internal width of the or each aperture being slightly greater than the cross-sectional width of the respective members. Between each aperture and each adjacent retaining member, the plate may be formed with a hole for securing it or a segment thereof by a nail or screw.

27 Claims, 9 Drawing Figures

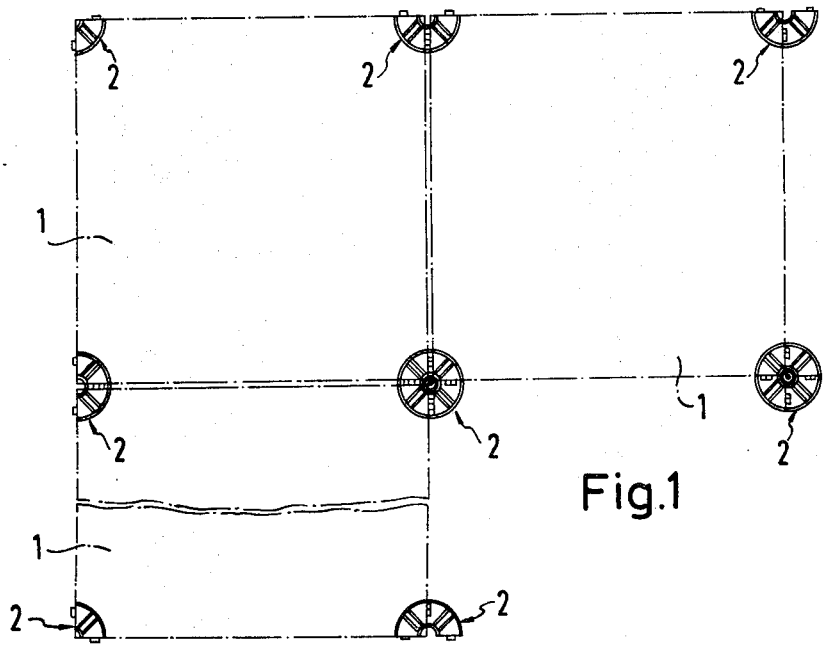
Fig.1
Fig.2
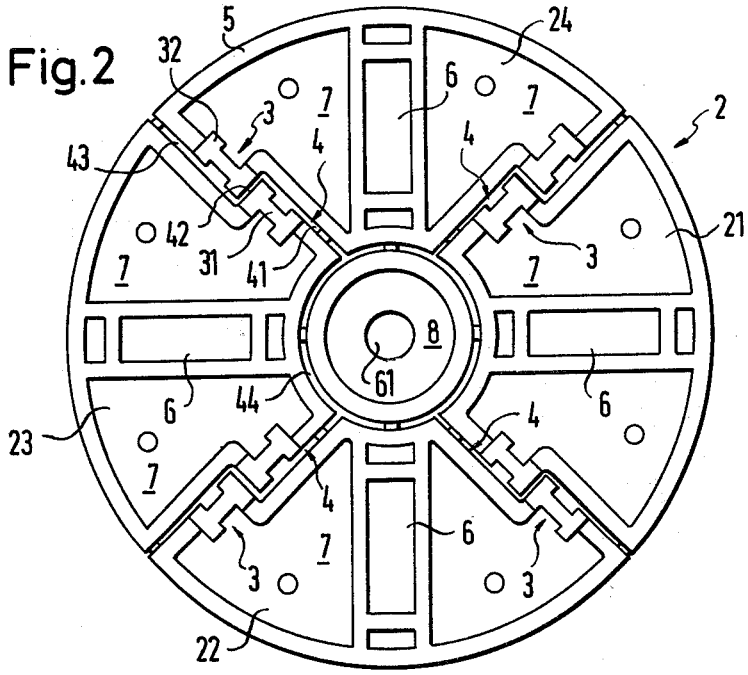

SUPPORTS FOR CONSTRUCTIONAL OR BUILDING ELEMENTS

The present invention relates to a support for constructional or building elements, more particularly to a device for laying on or securing to a base, such elements which are flat, for example, slabs or tiles used for floors, walls or ceilings, with a spacing one above the other, which device comprises a support plate arranged to engage a region of an edge or corner joint of the element and having one planar face and another face which comprises four dogs offset by 90° relatively to one another and arranged to engage respectively between pairs of adjacent elements.

Such support plates have been found useful in laying footpath slabs, terrace slabs, and the like. A disadvantage in previously proposed constructional forms of this kind is that the support plates project in the intended region of free edges or corners of the elements to be laid and for this reason often cannot be used in such cases or have an unattractive appearance.

According to the present invention, I provide a device for laying on, or securing to, a wall or base, flat building elements, which device comprises a first support plate arranged to engage an edge or corner joint of the element, and having one planar face, and another face which comprises four dogs offset by a 90° relatively to one another about an axis and arranged to engage respectively between pairs of adjacent elements, each dog being divided by a respective line extending substantially radially from the centre of the plate, along a portion of that line, the portions being offset by 90° relatively to one another about the axis.

In the present device, the support can be applied to many uses by simple manipulation, including some unconventional uses. The device is suitable for use when the building elements comprise floor, wall, or ceiling tiles or slabs.

The invention will now be more particularly described with reference to the accompanying drawings, wherein;

FIG. 1 is a view of a structure comprising plate-shaped building elements assembled together with a device for laying them on, or securing them to, a base;

FIG. 2 shows in elevated view a single support plate of the structure shown in FIG. 1;

Figure 3:
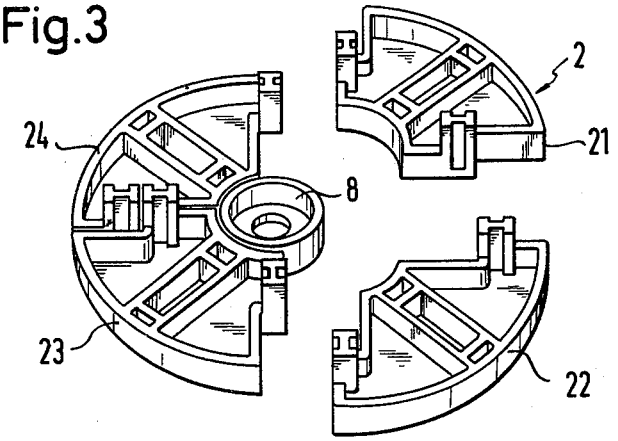
FIG. 3 shows a single support plate similar to that shown in FIG. 2, when fragmented.

FIG. 1 shows an assembly of three plate-shaped constructional elements 1, for example footpath or terrace slabs. In the region of an edge or corner joint of each element 1 a first support plate 2 or a portion of such a plate 2 is arranged on a laying base.

FIG. 2 shows the support plate 2 in detail. In the illustrated constructional example the plate 2 is in the form of a disc. The support plate 2 is placed on the base or secured thereto, at the face of the plate 2 remote from the plane of the drawing. The plate 2 comprises on diameters thereof four dogs 3 which are offset by 90° relatively to one another about an axis and which are in use as abutments and joint-forming means for the constructional elements 1 in the embodiment of FIG. 1. From the center of the support plate 2, four lines or boundaries 4 extend radially, and they divide respective dogs 3.

In the constructional example shown in FIG. 2, each line 4 extends along a first portion 41 thereof directly alongside the respective dog 3 to about half the radial extent of that dog 3. That line 4 extends thence along a second portion 42 thereof transversely to the axis dividing the dog 3 into two halves, thus forming therefrom two dogs 31, 32. The line 4 extends thence along a third portion 43 thereof from the dog 3 immediately beside that dog 3, outwardly at the side of the dog 3 opposite the first portion 41. A connection of four segments 21, 22, 23 and 24 which are produced in this way is maintained by small webs which are not shown in the drawings. Symmetrically between each respective pair of adjacent dogs 3 an aperture 6 is disposed formed in the plate 2, of which aperture 6 the internal clear width is slightly greater than that of the cross-section of those dogs 3. Respective recesses 7 are also arranged between each aperture 6 and the respective pair of adjacent dogs 3 by means of raised edges on the support plate 2. Each recess 7 is suitable for housing non-rotatably a respective dog of a further support plate placed on the first support plate 2 in an inverted position. At the center thereof the plate 2 has a disc 8 which is divided from what surrounds it by a boundary 44 at which the disc 8 can be removed and the disc 8 is formed with a central hole 61 through which the plate 2 or a portion thereof may be secured to a base by means of a nail or screw or the like. Similar holes for fixing can also be formed in the bottom of the recesses 7.

FIG. 3 shows how fragments 21, 22 of a support plate 2 can be broken off therefrom as shown in FIG. 2, to produce quarter plates 21, 22 or a half plate 23, 24, which can be used as shown in FIG. 1. The central disc 8 (FIGS. 2 and 3) may also be broken out from the rest of the plate 2 to allow under-packing for example in the case of slabs or tiles which are elastic or are of a large surface area. The plate 2 is preferably formed between each aperture 6 (FIG. 2) and each adjacent dog 3 with a respective hole for securing the plate 2 or the quarter plate 21 or 22 or half plate 23 or 24 thereof by means of a nail or screw.

Figure 4:
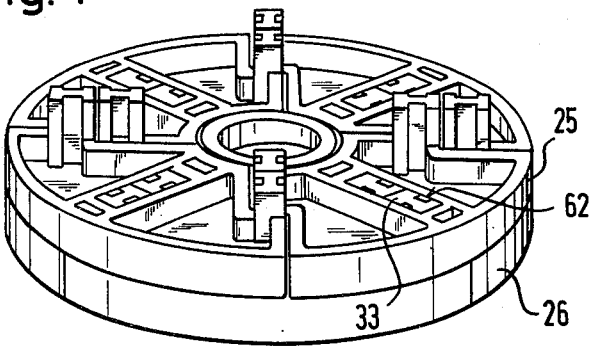
FIG. 4 is a view of two plates placed one on the other, suitable for use in a device similar to that shown in FIG. 1.

FIG. 4 shows how two support plates 25, 26 can be placed flush one on the other in order to obtain for example twice the spacing from the ground for the plate-shaped constructional elements 1 (FIG. 1). The dogs 33 (FIG. 4) of the lower plate 26 of the plates 25, 26 engage the apertures 62 of the upper support plate 25, finishing flush with one another.

Figure 5:
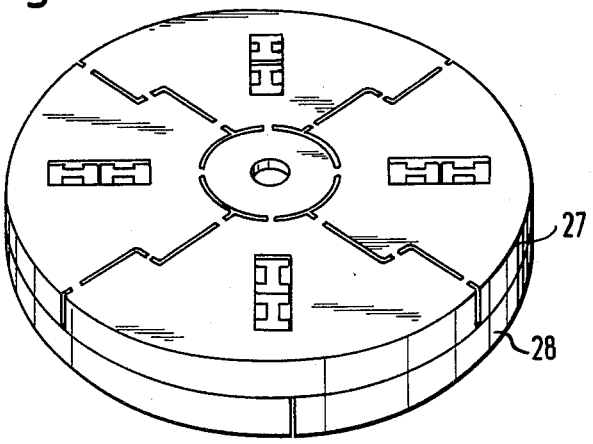
FIG. 5 shows two plates one on the other with one in an inverted position relatively to the other, suitable for use in a device similar to that shown in FIG. 1.

FIG. 5 shows how two support plates 27, 28 can also be placed head to tail one on the other, dogs of one supporting plate engaging apertures of the other plate. Dividing boundaries are always staggered when the plates 27, 28 are stacked, which is advantageous for strength reasons. In this form of stack the support plates 27, 28 are used only as packing supports. Instead the two support plates 27, 28 can be offset by 30° relatively to the arrangement of FIG. 5. In such a case, the dogs 3 of each support plate 27 or 28 are situated in the recesses 7 (See FIG. 2) of the other support plate 28 or 27, respectively. The two support plates 27, 28 no longer lie flush one on the other but have a spacing corresponding to their thickness. Since the upper support plate 27 bears on the lower plate 28 only by way of the dogs 3, it can yield elastically. This arrangement is particularly suitable, for example, as a support for a resilient floor.

Figure 6:
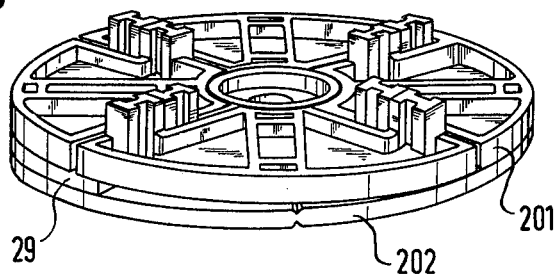
FIG. 6 shows two plates in an inclined position placed one on the other, suitable for use in a device similar to that shown in FIG. 1.

FIG. 6 shows how by arrangement of a quarter segment 29 between two portions 201, 202 constituting a support plate a slope can be produced or an existing slope on a base can be leveled off. The two portions 201, 202 shown are of different thickness. The portions 201, 202 are advantageously provided with uniformly graduated thicknesses, for example, 3, 6 and 9 millimeters or multiples thereof. They can also be constructed with two or more diameters or may be rectangular in shape, preferably square. There may alternatively be more than two portions similar to the portions 201, 202 and such portions are preferably of the same cross-sectional shape.

Figure 7:
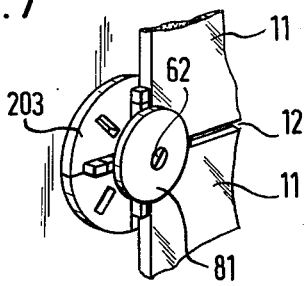
FIG. 7 shows a device for securing flat building elements to a wall.

FIG. 7 shows a support plate 203 in use serving to fix plate-shaped constructional elements 11, for example, tiles, facade panels or the like, on a wall. The support plate 203 is again arranged in the region of a corner joint of panels 11, dogs forming joints 12 of equal thickness. By means of a rosette 81 engaging the corner joint, which rosette 81 may be identical to the disc 8 which can be broken out of the plate 2 (see FIG. 2) and a screw 62, the panels 11 (FIG. 7) are secured to the wall together with the supporting plate 203.

Figure 8:
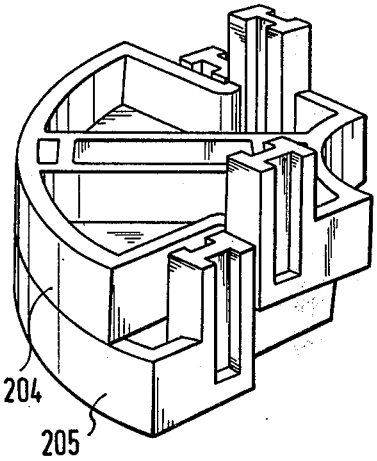
FIG. 8 shows two quarter segments of plates placed one on the other to face in the same direction, suitable for use in a device for laying flat building elements on a base.
Figure 9:
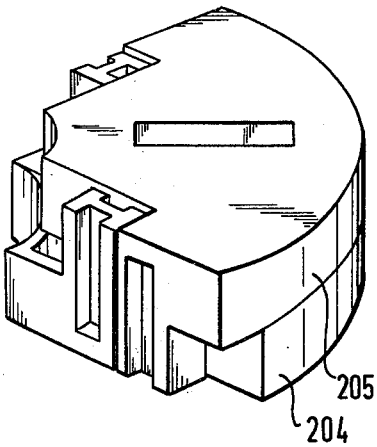
FIG. 9 shows two quarter segments of plates placed one on the other with one in an inverted position relatively to the other, suitable for use in a device for laying flat building elements on a base.

FIGS. 8 and 9 show two possibilities for stacking quarter segments 204 and 205 which in one case (FIG. 8) are placed one on the other to face in the same direction and in the other case (FIG. 9) are placed one on the other with one in an inverted position. FIG. 9 shows how the dogs in each case engage in one another in the manner of tooth systems so that even relatively small segments can be secured without the possibility of shifting in a horizontal plane.

The foregoing description has been able to discuss only a few selected examples of use, but these show the many possibilities. The support plate can be used not only for the laying or securing of flat constructional or building elements, but also for connecting plates or panels to one another, for example in furniture construction or for stacking panels in storage and transport work. Finally, the support plate can also by used in constructional model work, as for example, a toy building component.

Obviously, many modifications and variations of the present invention are possible in the light of the above teachings. It should therefore be understood that within the scope of the appended claims the invention may be practiced otherwise than as specifically described.

What I claim is:

1. A constructional arrangement comprising: at least one constructional element, support plate means arranged to engage at least an edge or a corner joint of the constructional element, the support plate means having a first and second planar face, said second planar face having four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° relative to one another about an axis perpendicular to the support plate means and extending radially outwardly from the center of said support plate means, a dog is disposed along each lateral edge portion at half the radial extent thereof, each of said lateral edge portions including a first radially outwardly extending edge surface, a second edge surface extending transversely to the first edge surface, and a third edge surface extending radially outwardly from said second edge surface at a position spaced from said first edge surface, said second edge surface extending through a respective dog to divide the same.

2. An arrangement as claimed in claim 1, wherein the support plate means is disc shaped.

3. An arrangement as claimed in claim 1, wherein the support plate means is in the form of portions of uniformly graduated thicknesses and the same cross-sectional shape.

4. A constructional arrangement comprising: at least one constructional element, support plate means arranged to engage at least an edge or a corner joint of the constructional element, the support plate means having a first and second planar face, said second planar face having four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by 90° relative to one another about an axis perpendicular to the support plate means and extending radially outwardly from the center of said support plate means, the support plate means is apertured symmetrically betwwen each pair of adjacent dogs by apertures having an internal clear width greater than that of the cross section of the dogs.

5. An arrangement as claimed in claim 4, wherein the support plate means is disc-shaped.

6. A constructional arrangement comprising: at least one constructional element, support plate means arranged to engage at least an edge or a corner joint of the constructional element, the support plate means having a first and second planar face, said second planar face comprising four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° about the axis perpendicular to the support plate means and extending radially outwardly from the center of said support plate means, one of said dogs is disposed along each lateral edge portion at half the radial extent thereof, each of said lateral edge portions including a first radially outwardly extending edge surface, a second edge surface extending transversely to the first edge surface, and a third edge surface extending radially outwardly from said second edge surface at a position spaced from said first edge surface, said second edge surface extending through a respective dog to divide the same, the support plate means has at its center a removable disc formed with a hole through which at least one of the support plate means or a portion of the support plate means may be secured to the constructional element by means of a nail or a screw.

7. An arrangement as claimed in claim 6, wherein the support plate means is in the form of portions of uniformly graduated thicknesses and the same cross-sectional shape.

8. A constructional arrangement comprising: at least one constructional element, support plate means arranged to engage at least an edge or a corner joint of the element, the support plate means having a first and second planar face, said second planar face comprising four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° about the axis perpendicular to the support plate means and extending radially outwardly from the center of said support plate means, the support plate means is apertured symmetrically between each pair of adjacent dogs by apertures having an internal clear width greater than that of the cross-section of the dogs, the support plate means has at its center a removable disc formed with a hole through which at least a portion of the support plate means may be secured to the constructional element by means of a nail or screw.

9. A constructional arrangement comprising: at least one constructional element, support plate means arranged to engage at least an edge or a corner joint of the constructional element, the support plate means having a first and second planar face, said second planar face comprising four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° about the axis perpendicular to the support plate means and extending radially outwardly from the center of said support plate means, the support plate means is apertured symmetrically between each pair of adjacent dogs by apertures having an internal clear width greater than that of the cross-section of the dogs, recesses are arranged between each aperture and the respective adjacent pair of dogs for housing nonrotatably a respective dog of a further support plate means placed on the first-mentioned support plate means in an inverted position.

10. A constructional arrangement comprising: at least one constructional element, support plate means arranged to engage at least an edge or a corner joint of the constructional element, the support plate means having a first and second planar face, said second planar face comprising four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° about the axis perpendicular to the support plate means and extending radially outwardly from the center of said support plate means, the support plate means is apertured symmetrically between each pair of adjacent dogs by apertures having an internal clear width greater than that of the cross-section of the dogs, between each aperture and each adjacent dog the support plate means is formed with a hole for securing at least a segment thereof by means of a nail or a screw.

11. An arrangement as claimed in claim 9, wherein between each aperture and each adjacent dog the support plate means is formed with a hole for securing at least a segment thereof by means of a nail and a screw.

12. A constructional arrangement comprising: at least one constructional element, support plate means arranged to engage at least an edge or a corner joint of the constructional element, the support plate means having a first and second planar face, said second planar face comprising four dogs offset by 90° relatively to one another about an axis perpendicular to the support plate means and arranged to engage respectively between adjacent constructional elements, each of said support plate means being divided into a plurality of segmental support elements terminating in lateral edge portions engageable with adjoining edge portions of adjacent segmental support elements, said lateral edge portions being offset by about 90° about the axis perpendicular to the support plate means and extending radially outwardly from the center of said support plate means, the support plate means has at its center a removable disc formed with a hole through which at least a portion of the support plate means may be secured to the constructional element by means of a nail or a screw.

13. A constructional arrangement comprising: at least one constructional element, support plate means arranged to engage at least an edge or corner joint of the constructional element, the support plate means including at least one individual segmental support element, said at least one segmental support element including lateral edge portions engageable with adjoining lateral edge portions of adjacent segmental support elements, the lateral edge portions of said segmental support elements extending radially outwardly from the center of said support plate means, said support plate means having a first and second planar face, said second planar face being provided with offset dog means arranged to engage between adjacent constructional elements, said dog means being disposed along each respective lateral edge portion of each segmental support element at substantially half the radial extent thereof, each of said edge portions of said segmental support elements includes a first surface portion extending radially outwardly from the center of the support plate means, a second surface portion at substantially half the total length of the edge portion extending transversely to said first surface portion, and a third surface portion extending radially outwardly from said second surface portion at a position spaced from said first surface portion.

14. An arrangement as claimed in claim 13, wherein the support plate means is disc-shaped.

15. An arrangement as claimed in claim 13, wherein the support plate means is in the form of portions of uniformly graduated thicknesses and the same cross-sectional shape.

16. An arrangement according to claim 13, wherein means are provided at the center of said support plate means for permitting an underpacking of said support plate means.

17. An arrangement according to claim 16, wherein means are provided between adjacent dog means for accommodating a fastening element to fasten said support plate means to said constructional element.

18. An arrangement according to claim 17, wherein means are provided between adjacent dog means for accommodating the dog means of a further support plate means disposed on said first support plate means in an inverted position.

19. An arrangement according to claim 13, wherein a further plate is provided and disposed adjacent said first planar surface.

20. An arrangement according to claim 19, wherein an additional plate is interposed between at least a portion of said support plate means and said further plate.

21. An arrangement according to claim 20, wherein said support plate means and said further plate have the same axial thickness.

22. An arrangement according to claim 20, wherein said support plate means and said further plate have differing axial thicknesses.

23. A constructional arrangement comprising: at least one constructional element, support plate means arranged to engage at least an edge or corner joint of the constructional element, the support plate means including at least one individual segmental support element, said at least one segmental support element including lateral edge portions engageable with adjoining lateral edge portions of adjacent segmental support elements, the lateral edge portions of said segmental support elements extending radially outwardly from the center of said support plate means, said support plate means having a first and second planar face, said second planar face being provided with offset dog means arranged to engage between adjacent constructional elements, said dog means being disposed along each respective lateral edge portion of each segmental support element at substantially half the radial extent thereof, at least two support plate means are provided and disposed one above the other, the dog means of the lower of said at least two support plate means extending between adjoining edge portions of adjacent support elements of the upper of said at least two support plate means.

24. An arrangement according to claim 23, wherein said at least two support plate means have the same axial thickness.

25. An arrangement according to claim 24, wherein a further plate is interposed between at least a portion of said at least two support plate means.

26. An arrangement according to claim 23, wherein said at least two support plate means have differing axial thicknesses.

27. An arrangement according to claim 23, wherein the dog means of the lower of said at least two support plate means extends from the second planar surface therof in the direction of the upper of said at least two support plate means, and the dog means of the upper of said at least two support plate means, and the dog means of the upper of said at least two support plate means extends from the second planar surface thereof in the direction of the lower of said at least two support plate means.

* * * * *